US005778772A

United States Patent [19]

Schwede

[11] Patent Number: 5,778,772

[45] Date of Patent: Jul. 14, 1998

[54] STRAP GUIDING FRAME FOR A LOOPING MACHINE

[75] Inventor: Horst Schwede, Bindlach, Germany

[73] Assignee: SMB Schwede Maschinenbau GmbH, Goldkronach, Germany

[21] Appl. No.: 882,270

[22] Filed: Jun. 25, 1997

[30] Foreign Application Priority Data

Jul. 19, 1996 [DE] Germany ..... 296 12 531 U

[51] Int. Cl.[6] ..... B65B 13/06

[52] U.S. Cl. ..... 100/26; 53/589

[58] Field of Search ..... 100/1, 8, 25, 26, 100/29, 32, 33 PB; 53/589

[56] References Cited

U.S. PATENT DOCUMENTS

| | | | |
|---|---|---|---|
| 3,070,001 | 12/1962 | Feldkamp . | |
| 3,118,368 | 1/1964 | Lems | 100/26 |
| 3,179,037 | 4/1965 | Cranston, Jr. et al. | 100/26 |
| 3,279,354 | 10/1966 | Dickens et al. | 100/26 |
| 3,572,237 | 3/1971 | Kurihara . | |
| 4,781,110 | 11/1988 | Sakaki et al. | 100/26 |
| 4,867,053 | 9/1989 | Kawai et al. | 100/26 |
| 5,414,980 | 5/1995 | Shibazaki et al. | 100/26 |

FOREIGN PATENT DOCUMENTS

| | | | |
|---|---|---|---|
| 1846183 | 12/1961 | Germany . | |
| 0223988 | 6/1987 | Germany . | |
| 3708267 | 9/1987 | Germany . | |
| 3-29718 | 2/1991 | Japan | 100/1 |
| 4-253607 | 9/1992 | Japan | 100/1 |

OTHER PUBLICATIONS

Hasegawa, K.; "Guide Frame for Packing Machine", Patent Abstracts of Japan; vol. 15; No. 160, 3–29718 Apr. 22, 1991.

*Primary Examiner*—Stephen F. Gerrity
*Attorney, Agent, or Firm*—Browdy and Neimark

[57] ABSTRACT

In a strap guiding frame for a looping machine, comprising a frame base and an encircling strap channel for a looping strap to be guided around a product stack, the strap channel being formed on the frame base by a guide bar, which is located on the frame base and defines the strap channel externally, and by a movable cover, which defines the strap channel internally toward the product stack and which is composed of a plurality of overlapping lamellae lined up in the direction of circulation of the looping strap, the lamellae being spring-mounted on the frame base in such a way that when the looping strap is tautened around the product stack, they can be lifted off the frame base for the automatic opening of the strap channel, it is provided, with a view to constructionally simplify the spring-mounting of the lamellae without impairing their impeccable opening and closing behavior, that the spring-mounting of the lamellae is formed by a rubber-elastic spring plate, which is supported on an associated support located on the frame base, and on which the lamella is suspended.

19 Claims, 6 Drawing Sheets

STRAP GUIDING FRAME FOR A LOOPING MACHINE

BACKGROUND OF THE INVENTION

1. Field of the Invention

The invention relates to a strap guiding frame for a looping machine, comprising a frame base and an encircling strap channel for a looping strap to be guided around a product stack, the strap channel being formed on the frame base by a guide bar, which is located on the frame base and defines the strap channel externally, and by a movable cover, which defines the strap channel internally toward the product stack and which is composed of a plurality of overlapping lamellae lined up in the direction of circulation of the looping strap, the lamellae being spring-mounted on the frame base in such a way that when the looping strap is tautened around the product stack, they can be lifted off the frame base for the automatic opening of strap channel.

2. Background Art

Strap guiding frames of the generic type form a substantial component of a looping machine, ensuring that the looping strap is guided as a loose loop around a product stack positioned in the frame opening. The strap customarily transported by an insertion device is properly guided through the encircling strap channel of the strap guiding frame.

For being tautened around the product stack, the strap must be able to move out of the strap channel. To this end, the prior art teaches flaps disposed on the inside of the strap channel, which are controlled by special drives and which are pivoted out of the looping plane before the strap is tautened and open the strap channel inwards.

The invention proceeds from a passive cover—not motor controlled—of the strap channel as closest prior art. In addition to a guide bar disposed on the frame base and externally defining the strap channel, the strap channel of this prior art is provided with a movable cover composed of a plurality of overlapping lamellae lined up in the direction of circulation of the strap. The lamellae are spring-mounted on the frame base in such a way that they are actuated by the looping strap when it is tautened and are lifted off the frame base, opening of the strap channel thus taking place virtually automatically.

Spring-mounting these lamellae is put into practice by helical springs coiled comparatively closely and on block in the extreme and which are mounted to stand out at right angles from the frame base. The foot of the respective helical spring is placed for instance on a pin fixed on the frame base. The head of the helical spring is joined to the lamella by screwing. At least two helical springs of this type have to be provided per lamella.

A drawback of this known spring-mounting of the lamellae resides in the high constructional requirements for spring and lamella mounting. Furthermore, the springs and lamellae must be properly adjusted for impeccable opening and closing of the lamellae to be ensured.

SUMMARY OF THE INVENTION

Proceeding from these problems, it is the object of the invention to constructionally simplify the spring-mounting of the lamellae without impairing their impeccable opening and closing behavior.

This object is attained by a rubber-elastic spring plate being used for spring mounting each lamella, the spring plate being supported on an associated support located on the frame base and the lamella being suspended on it.

The spring plate according to the invention is a component that is by far easier to produce and mount than the prior art helical springs. Each spring plate has a spring behavior favorable for the present application, comparatively high rigidity prevailing in the plane of the plate, while a very flexible deflection behavior is obtained at right angles to the plane of the plate. This means that the lifting of the lamellae and the deflection motion incident thereto of the spring plate at right angles to its main plane take place comparatively easily, while the lamellae are kept clean in their lapping positions of mounting.

Attention is drawn to the fact that the term "lamellae" not only means the pressworked and bent parts of sheet steel per se known from the prior art. Rather, according to preferred improvements, lamellae are conceivable, which are especially easy to manufacture, it being possible from the start to provide them with corresponding fixtures for the spring plates. This further reduces the manufacturing requirements for the strap guiding frame.

Further features, details and advantages of the invention will become apparent from the ensuing description of embodiments of the subject matter of the invention, taken in conjunction with the drawing.

DESCRIPTION OF THE PREFERRED EMBODIMENTS

Figure 1:
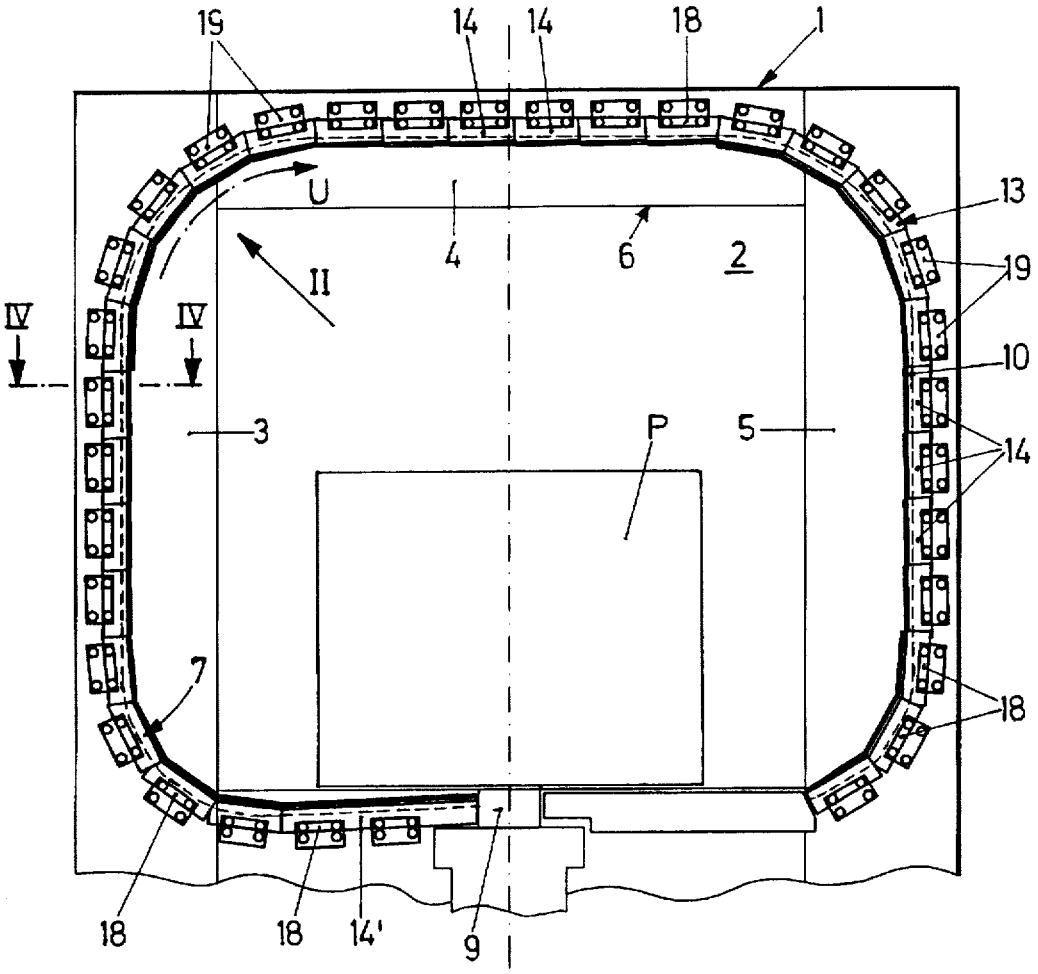
FIG. 1 is a lateral view of a first embodiment of a strap guiding frame for a looping machine.

FIG. 1 illustrates the strap guiding frame 1 as part of a looping machine (not shown in detail) and customarily disposed on the table of the machine. The frame 1 forms an opening 2 into which the product stack P to be looped is inserted by the aid of a conveying device and from which it is discharged after the looping job.

The strap guiding frame 1 comprises a frame base 6 composed of corresponding plate elements 3, 4, 5 and only diagrammatically outlined in FIG. 1. Furthermore, the strap guiding frame 1 is provided with an encircling strap channel 7 for the looping strap 8 (see FIGS. 2 to 5) to be guided around a product stack P. From a welding head 9 (diagrammatically outlined in FIG. 1) disposed underneath the opening 2, the strap channel 7 leads around the legs of the strap guiding frame 1 and back to the welding head 9.

As outlined by dashed lines in FIG. 1, the strap channel 7 is externally defined by a guide bar 10, which is installed on the frame base 6 and mounted on the respective plate elements 3, 4 and 5 by corresponding angles 11 (FIG. 4) in such a way that an encircling guide surface 12 is formed for the looping strap 8. The inserted looping strap 8 runs along this guide surface 12.

Internally, toward the product stack P, the strap channel 7 is defined by a movable cover 13, which is composed of a plurality of lamellae 14 lined up in the direction of circulation U.

Figure 2:
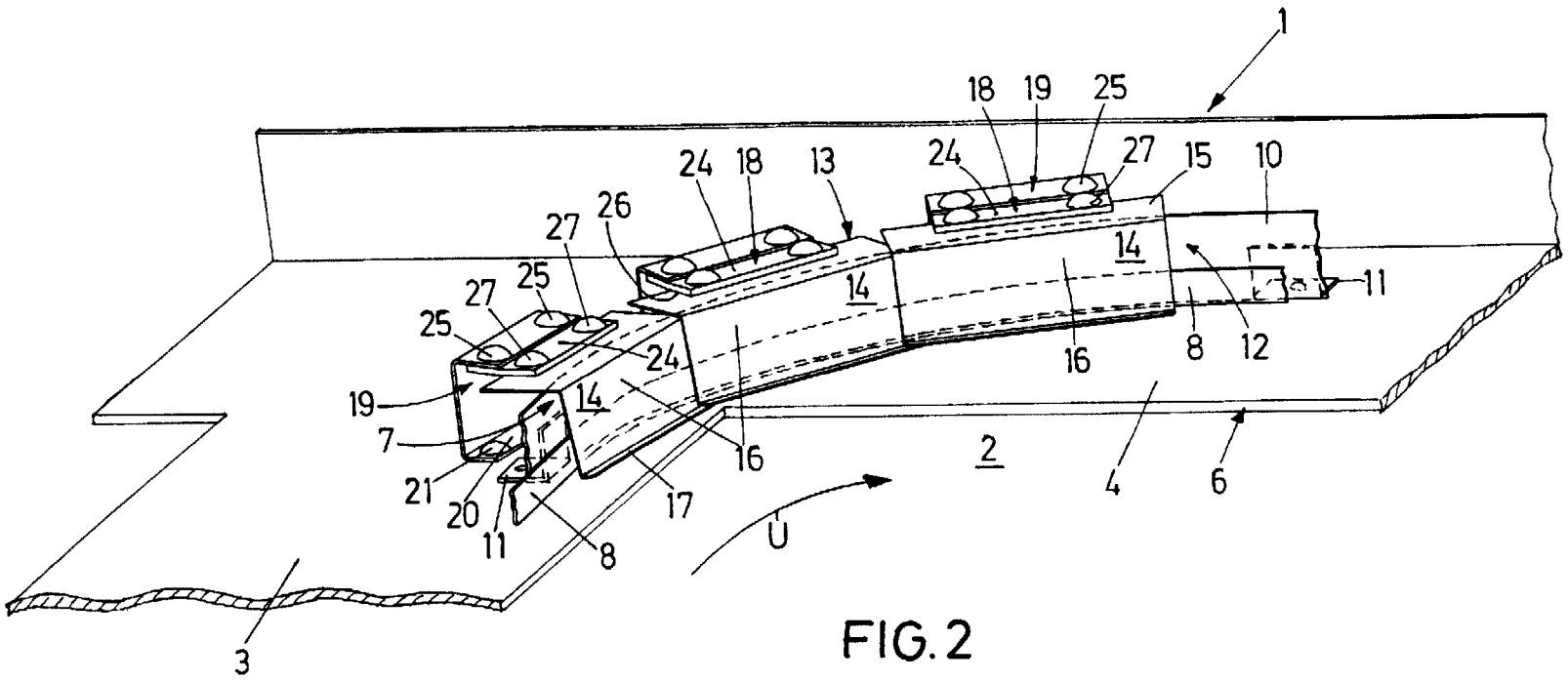
FIG. 2 is a perspective detailed view by extract of the strap guiding frame from the direction of the arrow II of FIG. 1 with the strap channel in a closed condition.
Figure 4:
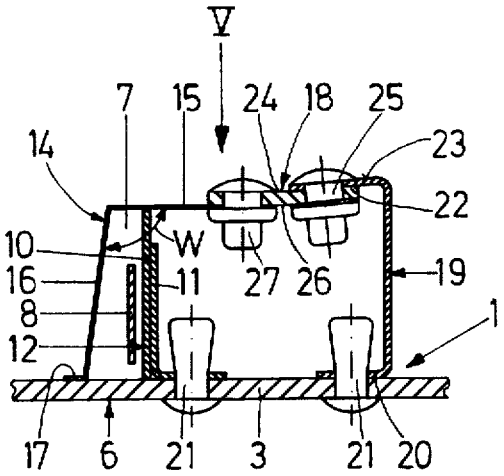
FIG. 4 is a horizontal section by extract through the strap guiding frame on the section line IV—IV of FIG. 1.

As seen in FIGS. 2 and 4, each lamella 14 is an angle steel sheet having a bearing leg 15 substantially parallel to the frame base 6 and a wall leg 16 which combines with the bearing leg 15 to form an obtuse angle W slightly exceeding 90°. At its free end, the wall leg 16 has an edged portion 17 by which to rest on the frame base 6.

Figure 3:
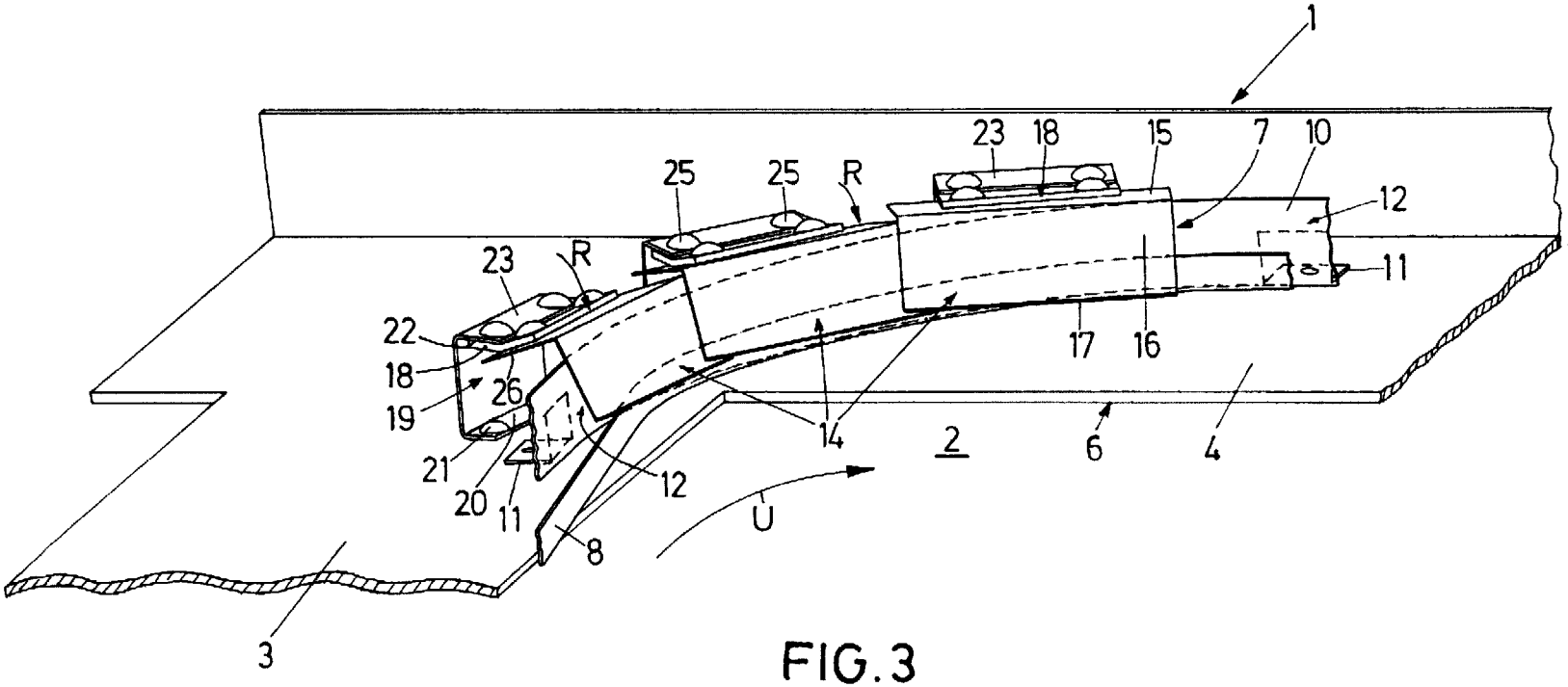
FIG. 3 is a view analogous to FIG. 2 with the strap channel in a partially opened condition.

As seen in FIGS. 1 to 3, each lamella 14 and each subsequent lamella 14 overlap, the lamella 14 following in the direction of circulation being placed from outside on the advancing lamella 14. As a result, there are no edges projecting into the strap channel 7 against the direction of insertion of the looping strap 8, which would impair the insertion of the strap. As can be seen in FIG. 4 in particular, the cross-sectional shape of the strap channel 7 is trapezoidal, it being defined—as explained—externally by the guide surface 12 of the guide bar 10, internally by the wall leg 16 of the lamella 14 and in the vicinity of its two narrow sides by the corresponding portions of the frame base 6 and the bearing leg 15, respectively, which, in the closed condition of the strap channel 7 seen in FIG. 4, rests on the guide bar 10.

Figure 5:
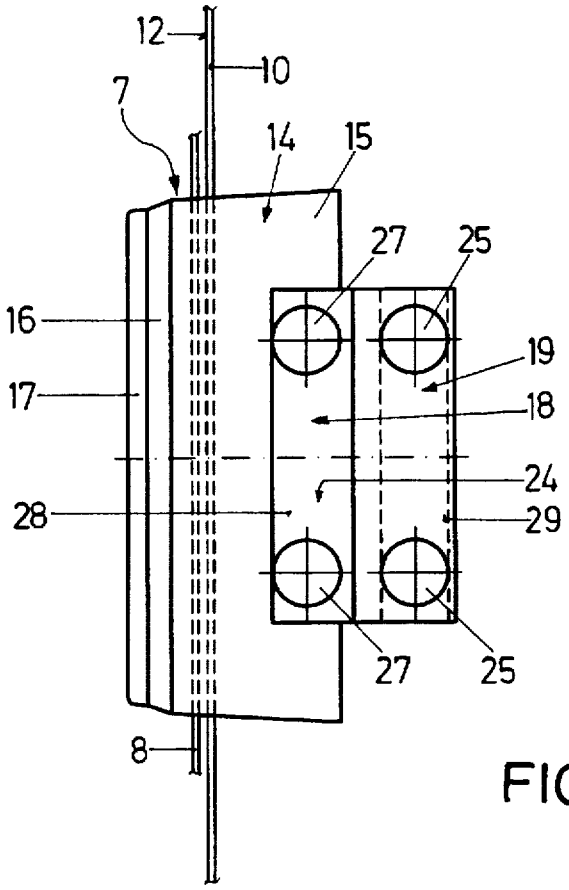
FIG. 5 is a detailed plan view of the strap guiding frame from the direction of the arrow V of FIG. 4.

By the aid of a spring plate 18 and by way of a support 19, each spring plate 18 is spring-mounted on the frame base 6 in such a way that when the looping strap is tautened around the product stack P, it can be lifted off the frame base 6 for the automatic opening of the strap channel 7. Each spring plate 18 is of elongated rectangular shape, made from rubber-elastic material such as polyurethane rubber. Each support 19 is a section U-shaped in cross-section, one leg 20 of which is fixed to the frame base 6 by corresponding rivets 21. The upper base 24 of the spring plate 18 bears against the inside 22, turned toward the frame base 6, of the second leg 23, where it is fixed by two corresponding rivets 25. The spring plate 18 is sufficiently wide to stand out from the leg 23 and, on its lower base 26, carries the respective lamella 14 which is fixed to the spring plate 18 by another two rivets 27. As seen in FIG. 5, the length of the support 19 and of the spring plate 18 is approximately half the length of the lamella 14. Furthermore, the support 19 and the lamella 14 are fixed parallel to each other on the lengthwise portions 28, 29, turned away from each other, of the spring plate 18.

With reference to FIG. 1, attention is drawn to the fact that due to the simple way of mounting of the lamellae 14 with the aid of the spring plates 18 and the supports 19, the manufacturing requirements readily justify using lamellae, spring plates and supports of a uniform overall length of for instance 10 cm over the entire encircling length of the strap guiding frame 1. The use of lamellae 14' that are longer in the straight portions of the strap channel 7 is fundamentally known from the prior art and leads to an increase of the number of different components needed to assemble the machine.

The automatic, passive opening mechanism is explained, based on FIGS. 2 and 3:

After insertion of the looping strap 8 into the strap channel 7, as seen in FIG. 2, the leading end of the looping strip 8 is retained in the welding head 9 and the strap is pulled back. In this way, the loop formed contracts and acts on the lamellae 14 which escape upward due to the spring-mounting by the spring plates 18, leaving the strap channel 7 free internally (FIG. 3). When the looping strip 8 has slipped through under the edged portions 17 of the lamellae 14, the restoring force R acting due to the deflection of the spring plates 18 returns the lamellae 14 into the initial position seen in FIG. 4. The strap channel 7 thus being closed, the looping strap 8 can again be inserted for another looping job.

Figure 6:
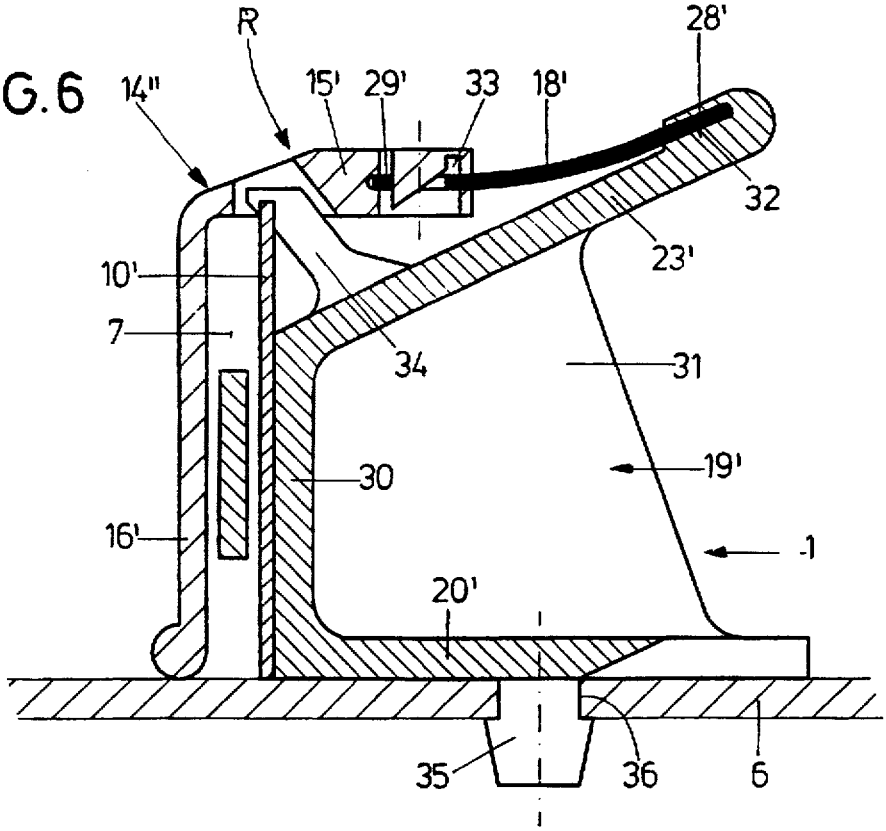
FIG. 6 is a horizontal section analogous to FIG. 4 through a second embodiment of a strap guiding frame.

FIG. 6 illustrates another embodiment of a strap guiding frame 1 according to the invention. In this case, the support 19' is an injection-molded part of U-shaped cross-section, one leg 20' of which is fixed to the frame base 6. The second leg 23' does not run parallel to the lower leg 20', but obliquely upward from the base 30 and is supported for stability by an intermediate rib 31. Again the spring plate 18' is inserted into a groove 32 on the free end of the upper leg 23', the support 19' extending at least over the length of this spring plate 18'. As a result, the lengthwise portion 28', on the side of the legs, of the spring plate 18' is enclosed by the groove 32 over its entire length.

The lamella 14" is fixed to the opposed lengthwise portion 29' of the spring plate 18' by a clips connection 33. Contrary to the lamellae of the embodiment according to FIGS. 1 to 5, the lamella 14" according to FIG. 6 is not an angle steel sheet, but a plastic injection-molded part easy to manufacture. By analogy to the lamellae 14, this injection-molded part is formed as an angled part comprising a bearing leg 15' and a wall leg 16'. In this regard, the basic structure does not differ from the lamellae 14 of the first embodiment. However, in terms of manufacturing, the injection-molded part is substantially less complicated and expensive.

FIG. 6 further illustrates the guide bar 10', which is a continuous metal strip held by the supports 19'. To this end, the supports 19' possess extension arms 34 applied by injection-molding, the virtually continuous guide bar 10' being clamped between them and the frame base 6. The lamellae 14" again support themselves on the upper edge of the guide bar 10'. With the aid of supports 19' of for instance approximately 5 cm of length and which comprise corresponding lamellae 14", a strap channel 7 can be realized on the frame base 6 in a modular design by a plurality of these supports 19' and lamellae 14" being lined up in the way seen in FIG. 1 and by the continuous guide bar 10' being subsequently inserted in between the extension arm 34 and the frame base 6. In the bent portions of the strap channel 7, the supports 19' form a curve in the shape of a polygon of forces, the guide bar 10' being uniformly bent, adapting itself to the curve, and supporting itself on the respective basis of the supports 19' only by line contact, as seen in FIG. 6.

By means of a locking nose 35, the support 19' is simply arrested in a corresponding opening 36 of the frame base 6.

Attention is drawn to the fact that FIG. 6 illustrates the support 19', the spring plate 18' and the lamella 14" as separate components. However, it is conceivable to place the spring plate 18' as a pre-injection-molded component into an injection mold and to injection-mold on it the support 19' and the lamella 14". It is also conceivable to injection-mold the spring plate 18' from a rubber-elastic material and the support 19' and the lamellae 14" from a dimensionally stable material in common in a single two-component injection-molding job.

Figure 7:
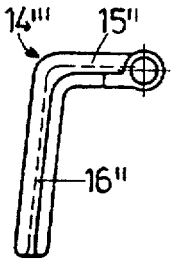
FIGS. 7 to 9 are lateral, front and plan views of another embodiment of a lamella in the form of an injection-molded part.
Figure 8:
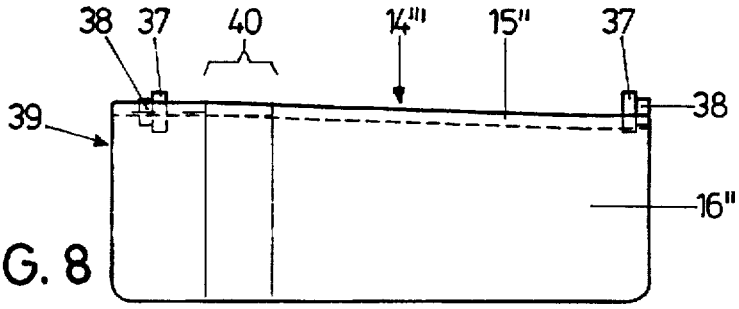
Figure 9:
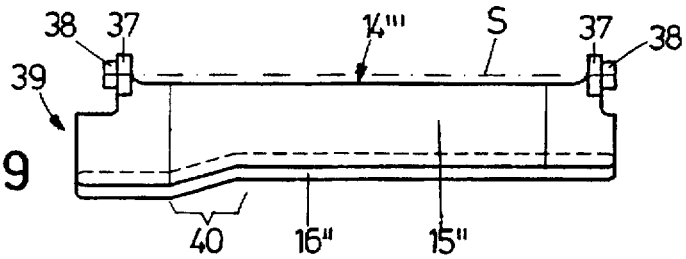

FIGS. 7 to 9 illustrate another embodiment of a lamella 14" in the form of a plastic injection-molded part. Again, it is substantially embodied as an angled part comprising a bearing leg 15" and a wall leg 16". In the vicinity of the two lengthwise ends of the bearing leg 15", flanges 37 are applied integrally by injection-molding, having axle stubs 38 which stand out in opposite directions and which are part of a hinge (still to be explained in detail) for the additional articulation of the lamellae 14" to the supports. In the vicinity of their lapped portion 39 on the inlet side where the end, on the outlet side, of the leading lamella imbricates under the following lamella, the lamellae 14'" are provided with an outward misalignment 40 in the vicinity of the bearing leg 15" as well as the wall leg 16". As a result, the successive lamellae 14'" can lap properly and form as smooth as possible a strap channel 7 inside.

Figure 10:
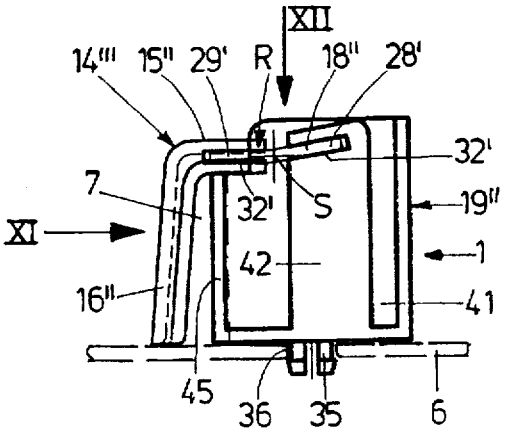
FIG. 10 is a diagrammatic section analogous to FIG. 4 through a unit of the support, spring plate and lamella on the section line X—X of FIG. 12, FIGS. 11 and 12 are views of the unit of FIG. 10 from the direction of the arrows XI and XII.
Figure 11:
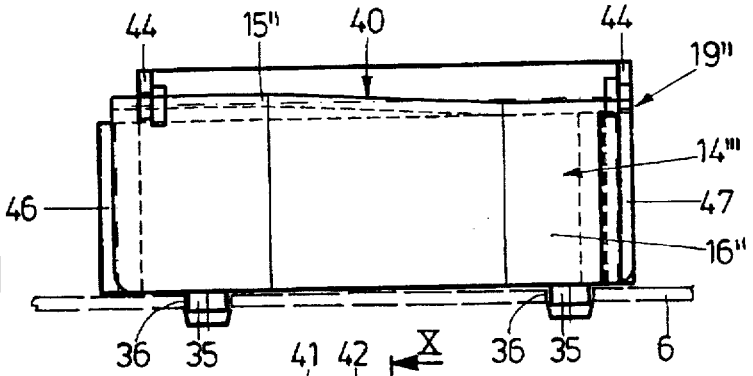
Figure 12:
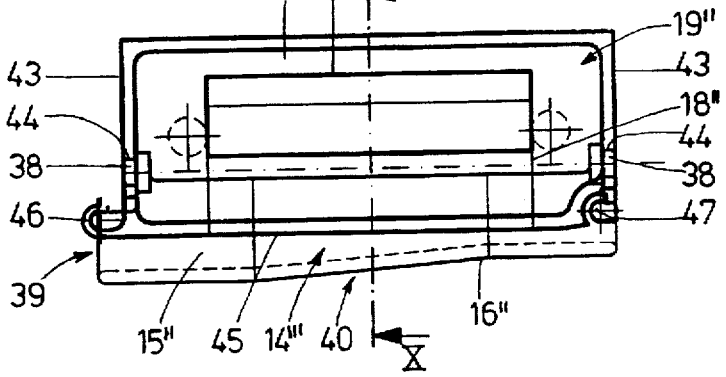

FIGS. 10 to 12 illustrate another embodiment of the invention, utilizing the lamellae 14'" seen in detail in FIGS. 7 to 9. As becomes apparent from these figures, the support 19" is a substantially box-type plastic injection-molded part arrested in openings 36 of the frame base 6 by way of locking noses 35. In its interior 41, the support 19" comprises an upright holding member 42, on the upper end of which an inclined groove 32' is disposed, receiving the corresponding lengthwise portion 28' of the spring plate 18". The other lengthwise portion 29' is appropriately arrested in the bearing leg 15" of the lamella 14'".

As seen in FIGS. 11 and 12, the narrow side walls 43 of the support 19" have recesses 44 at the upper end, with which engage the axle stubs 38 on the lamellae 14'", forming a hinge. The lamellae 14'" are thus articulated to the support 19" pivotally about the axis S, the pivot axis S—as seen in FIG. 10—lying in the vicinity of the plane of the spring plate 18". As a result of the flexion of the spring plate 18", as apparent from this figure, the lamella 14'" is prestressed in the closed position shown.

As seen in FIGS. 11 and 12, the length of the support 19" substantially corresponds to that of the lamella 14'". Furthermore, the inner wall 45 situated toward the strap channel 7 simultaneously forms the demarcation of this strap channel. So, the inner walls of supports 19" placed one after the other without gap will commonly form the guide bar 10 of the strap guiding frame. For a curved strap channel to be obtained, the inner walls of the supports 19" are provided with a projection nose 46 on one side and a matching recess 47 on the other side. Supports 19" are lined up for a strap channel curve, the projection nose 46 of a support 19" engaging with the corresponding recess 47 of the leading support. Since the projection nose 46 and the recess 47 form sort of an elongated ball-and-socket joint, two subsequent supports 19" can be disposed at an angle deviating from the elongation. The inner wall 45 having a course that stands back slightly in the vicinity of the receptacle 47, this ensures that there is not obstacle in the path of the leading end of the looping strap 8.

Attention is further drawn to the fact that the additional, pivotal articulation of the lamellae 14'" to the supports 19" ensures a defined opening and closing behavior during the actuation by the strap withdrawing from the strap channel 7. This means that the lapped portions, the dimensioning of which must always conform to the most unfavorable case during withdrawal of the looping strap 8, can be chosen more narrowly. This is accompanied with the advantage that less support/spring plate/lamella units are used per length of a strap guiding frame and that lower forces have to be applied by the strap for the opening of the strap channel 7.

Figure 13:
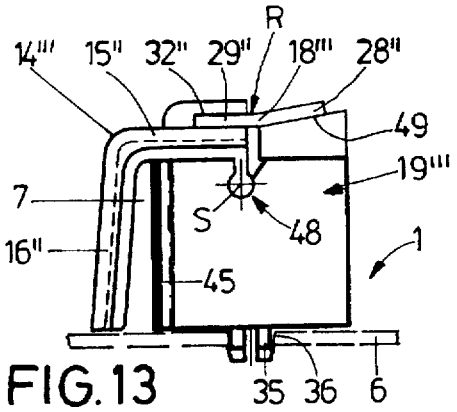
FIG. 13 is a diagrammatic section through another embodiment of a unit analogous to FIG. 10.

FIG. 13 finally illustrates a diagrammatic side view of another embodiment of the support/spring plate/lamella unit. Again, a lamella 14'" in the form of a plastic injection-molded part is used, in which the pivot axis S of the hinge diagrammatically outlined by 48 is not disposed in the plane of the spring plate 18'", but at a clear distance underneath. The lengthwise portion 29", on the side of the lamella, of the spring plate 18'", is arrested in a groove 32" in the lamella 14'". The other lengthwise portion 28" supports itself only on a corresponding inclination 49 of the support 19'". Again, the flexion of the spring plate 18'" generates prestressing of the lamella 14'". Furthermore, when the lamella 14'" is bent up, the distance of the pivot axis S from the plane of the spring plate 18'", and the further flexion of the spring plate 18'" will produce a pushing effect that keeps the spring plate 18'" within the groove 32". Consequently, the spring plate 18'" has to be fixed only on one side, this having a favorable effect on the mounting requirements.

What is claimed is:

1. A strap guiding frame for a looping machine, comprising a frame base (6) and an encircling strap channel (7) for a looping strap (8) to be guided around a product stack (P), the strap channel (7) being formed on the frame base (6) by a guide bar (10, 10'), which is located on the frame base (6) and defines the strap channel (7) externally, and by a movable cover (13), which defines the strap channel (7) internally toward the product stack (P) and which is composed of a plurality of overlapping lamellae (14, 14', 14", 14'") lined up in the direction of circulation (U) of the looping strap (8), the lamellae (14, 14', 14", 14'") being spring-mounted on the frame base (6) in such a way that when the looping strap (8) is tautened around the product stack (P), they can be lifted off the frame base (6) for the automatic opening of strap channel (7), wherein the lamellae (14, 14', 14", 14'") are each spring-mounted by a rubber-elastic spring plate (18, 18', 18", 18'"), which is supported on an associated support (19, 19', 19", 19") located on the frame base (6), and on which the lamella (14, 14', 14", 14'") is suspended.

2. A strap guiding frame according to claim 1, wherein the respective spring plate (18, 18', 18", 18'") is of elongated rectangular shape, the support (19, 19', 19", 19'") and the lamella (14, 14', 14", 14'") being fixed parallel to each other on lengthwise portions (28, 28', 28", 29, 29', 29"), turned away from each other, of the spring plate (18, 18', 18", 18'").

3. A strap guiding frame according to claim 1, wherein the support (19, 19') is a section of U-shaped cross-section, a first leg (20, 20') of which is mounted on the frame base (6) and on a second leg (23, 23') of which the respective spring plate (18, 18') is disposed.

4. A strap guiding frame according to claim 3, wherein the spring plate (18) is disposed on an inside (22), turned toward the frame base (6), of the second leg (23).

5. A strap guiding frame according to claim 3, wherein the lamella (14) and the second leg (23) of the support (19) are mounted on bases (24, 26), turned away from each other, of the spring plate (18).

6. A spring plate according to claim 1, wherein each lamella (14, 14', 14", 14'") is an angled part, a first leg of which is fixed as a bearing leg (15, 15', 15") to the spring plate (18, 18', 18", 18'") and, in a closed condition, rests on the guide bar (10, 10'), forming a narrow side wall of the strap channel (7), and a second leg of which, as a wall leg (16, 16', 16"), partially forms an inner side wall of the strap channel (7).

7. A strap guiding frame according to claim 6, wherein an edge of the wall leg (16) that rests on the frame base (6) has an edged portion (17).

8. A strap guiding frame according to claim 1, wherein the lamellae (14, 14'), spring plates (18) and supports (19) are fixed to each other by rivetings (25, 27).

9. A strap guiding frame according to claim 1, wherein at least on three sides of the strap guiding frame (1), the strap channel (7) is formed by lamellae (14, 14', 14", 14'"), spring plates (18, 18', 18", 18'") and supports (19, 19', 19", 19'") of a uniform overall length.

10. A strap guiding frame according to claim 1, wherein the spring plates (18, 18', 18", 18'") are formed from a rubber-like material.

11. A strap guiding frame according to claim 10, wherein the rubber-like material is polyurethane rubber.

12. A strap guiding frame according to claim 1, wherein the supports (19', 19", 19'") are plastic injection-molded parts.

13. A strap guiding frame according to claim 1, wherein the lamellae (14", 14'") are plastic injection-molded parts.

14. A strap guiding frame according to claim 13, wherein the lamellae (14", 14'") have a misalignment (40) in a portion (39) on an inlet side where they lap the neighboring lamella (14", 14'").

15. A strap guiding frame according to claim 1, wherein the lamellae (14", 14'") are additionally articulated to the supports (19", 19'") by way of a hinge (38, 44, 48).

16. A strap guiding frame according to claim 1, wherein the supports (19') are formed as holders for the guide bar (10').

17. A strap guiding frame according to claim 1, wherein the supports (19', 19") are elongated components and have guide legs (45) which, by the supports (19", 19'") being lined up without gap, combine to form the guide bar of the strap guiding frame (1).

18. A strap guiding frame according to claim 1, wherein lengthwise portions (28', 28", 29', 29") of the spring plates (18', 18", 18'") are fixed in grooves (32', 32") on one of the lamellae (14", 14'") and the supports (19', 19", 19'").

19. A strap guiding frame according to claim 1, wherein a support (19'), a lamella (14") and a spring plate (18') are formed in one piece as an injection-molded part.

* * * * *